United States Patent [19]

Kuo

[11] Patent Number: 4,729,558

[45] Date of Patent: Mar. 8, 1988

[54] RUNNING EXERCISER

[76] Inventor: Hai P. Kuo, 767 Jen AI Village Jen Ten Hsiang, Tainan Hsien, Taiwan

[21] Appl. No.: 786,636

[22] Filed: Oct. 11, 1985

[51] Int. Cl.[4] ..... A63B 23/06

[52] U.S. Cl. ..... 272/69; 272/DIG. 4

[58] Field of Search ..... 272/69, 73, DIG. 4; 474/26, 114, 115; 74/89.15, 501 A; D21/192

[56] References Cited

U.S. PATENT DOCUMENTS

| | | | |
|---|---|---|---|
| 348,226 | 8/1886 | Mayhew | 74/89.15 |
| 2,488,871 | 11/1949 | Locke | 474/26 |
| 2,791,126 | 5/1957 | Christopher | 474/114 X |
| 2,791,909 | 5/1957 | Rick | 74/89.15 |
| 2,963,966 | 12/1960 | Buttner | 474/114 X |
| 4,502,679 | 3/1985 | De Lorenzo | 272/69 |
| 4,591,147 | 5/1986 | Smith et al. | 272/69 |
| 4,635,928 | 1/1987 | Ogden et al. | 272/69 |

FOREIGN PATENT DOCUMENTS

| | | | |
|---|---|---|---|
| 3501440 | 7/1985 | France | 272/69 |
| 120015 | 8/1970 | Norway | 272/73 |
| 384019 | 12/1932 | United Kingdom | 272/69 |

OTHER PUBLICATIONS

Trotter Treadmills Inc., pp. 1 & 2, advertisement.

*Primary Examiner*—Richard J. Apley
*Assistant Examiner*—J. Welsh

[57] ABSTRACT

This invention relates to an improved running exerciser and in particular to one which mainly comprises a base frame having a first shaft and second shaft, a pair of inverted U-shaped members each mounted at one side of the base frame, a track in the form of endless loop around the first shaft and the second shaft, a pulley fastened on one end of the first shaft, a motor assembly having a tubular rod enclosing the first shaft, a pair of conical clutch discs put over a driving shaft of the motor assembly, a belt connecting the pulley to the clutch discs, a speed control mechanism mounted on one of the inverted U-shaped members for regulating speed of the track, and a stand for lifting front end of the base frame to incline the endless loop to form a slope.

1 Claim, 9 Drawing Figures

RUNNING EXERCISER

BACKGROUND OF THE INVENTION

This invention relates to an improved running exerciser.

Heretofore, many running exercisers have been developed and sold on the market. However, they have many drawbacks and should be improved. For instance, the running exerciser on the market operates at constant speed and hence cannot adapt to the needs of everybody. Further, the endless loop of the running exerciser is fixedly mounted in a horizontal plane thereby failing to provide another mode such as a slope for the user.

It is, therefore, an object of the present invention to provide an improved running exerciser which may eliminate the above-mentioned drawbacks.

SUMMARY OF THE INVENTION

It is the primary object of the present invention to provide an improved running exerciser the speed of which is adjustable.

It is another object of the present invention to provide an improved running exerciser the front end of which can be lifted to incline the track to form a slope.

It is still another object of the present invention to provide an improved running exerciser which is simple in construction.

It is still another object of the present invention to provide an improved running exerciser which is easy to operate.

It is a further object of the present invention to provide an improved running exerciser which is economic to produce.

It is still a further object of the present invention to provide an improved running exerciser which is facile to assemble.

Other objects and merits and a fuller understanding of the present invention will be obtained by those having ordinary skill in the art when the following detailed description of the best mode contemplated for practicing the invention is read in conjunction with the accompanying drawings wherein like numerals refer to like or similar parts and in which:

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1:
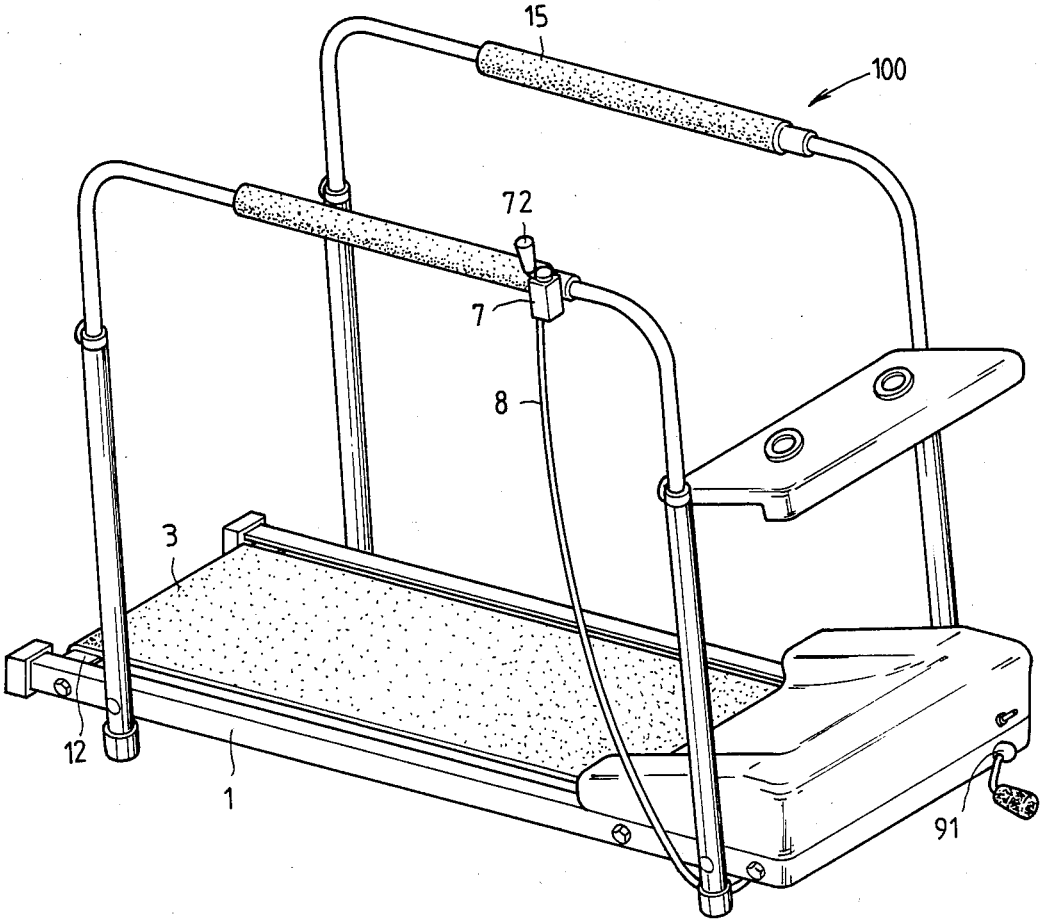
FIG. 1 is a perspective view of an improved running exerciser according to the present invention.
Figure 2:
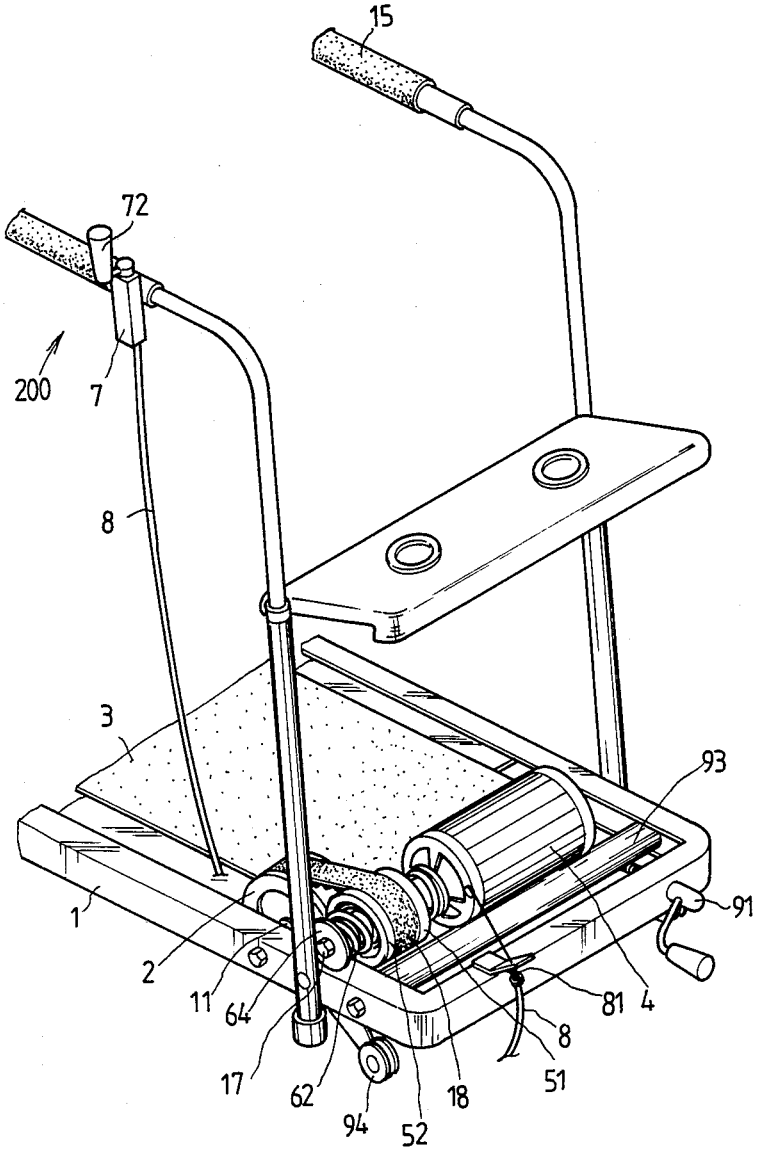
FIG. 2 shows the structure of the improved running exerciser.
Figure 4:
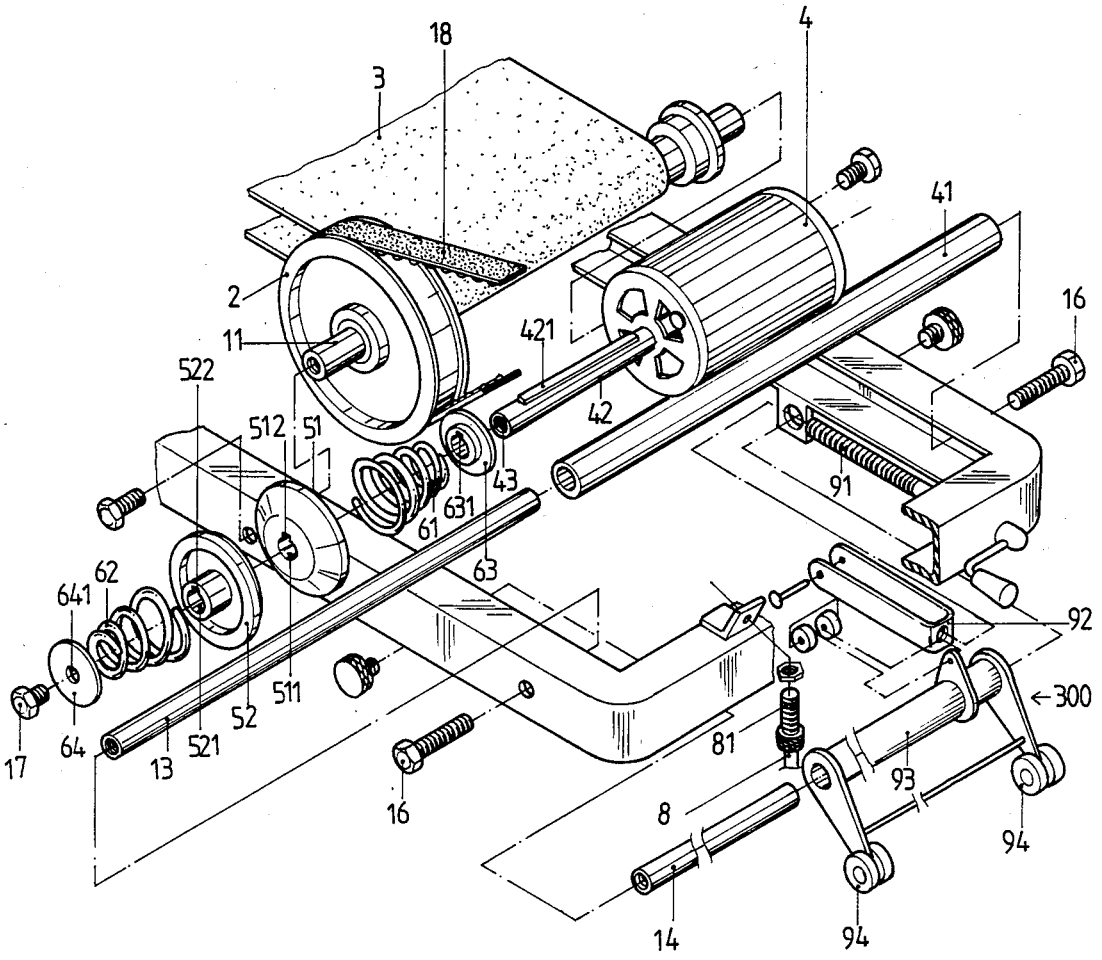
FIG. 4 is a fragmentary exploded view of the improved running exerciser.

With reference to the drawings and in particular to FIGS. 1, 2 and 4 thereof, the improved running exerciser 100 according to the present invention mainly comprises a base frame 1, a pulley 2, a track 3 and a motor assembly 4. The base frame 1 is provided with a first shaft 11 mounted across front part thereof, a second shaft mounted across rear part thereof, a first fixed rod 13, and second fixed rod 14. At two sides of the base frame 1 there are respectively mounted two inverted U-shaped members 15. The track 3 is in the form of a loop wrapping around the first shaft 11 and the second shaft 12. The pulley 2 is disposed on the first shaft 11 for driving the endless loop 3. The motor assembly 4 is provided with a tubular rod 41 which can be just put over the first fixed rod 13. The first fixed rod 13 is secured on the base frame 1 by screws 16. The motor assembly 4 is further provided with a driving shaft 42 having a key 421 formed integrally therewith. A stop disc 63 having a key slot 631 adapted to the key 421 of the driving shaft 42, a first helical spring 61, and a first conical clutch disc 51 formed with a center hole 511 having a keyway 512 adapted to the key 421 of the driving shaft 42 are in turn put over the driving shaft 42. Then, a second conical clutch disc 52 formed with a hole 521 having a keyway 522 adapted to the key 421 of the driving shaft 42 is put over the driving shaft 42, with the conical surfaces of the conical clutch discs 51 and 52 facing each other. A second helical spring 62 and a stop plate 64 are put over the driving shaft 42 in succession and then a screw 17 is secured to the free end of the driving shaft 41 thereby preventing the stop disc 63, the first helical spring 61, the first conical clutch disc 51, the second conical clutch disc 52, the second spring 62 and the stop plate 64 from dropping off.

Figure 3:
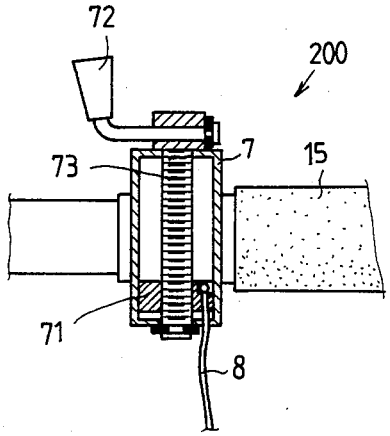
FIG. 3 is a fragmentary view showing the structure of the speed control mechanism of the improved running exerciser.
Figure 5:
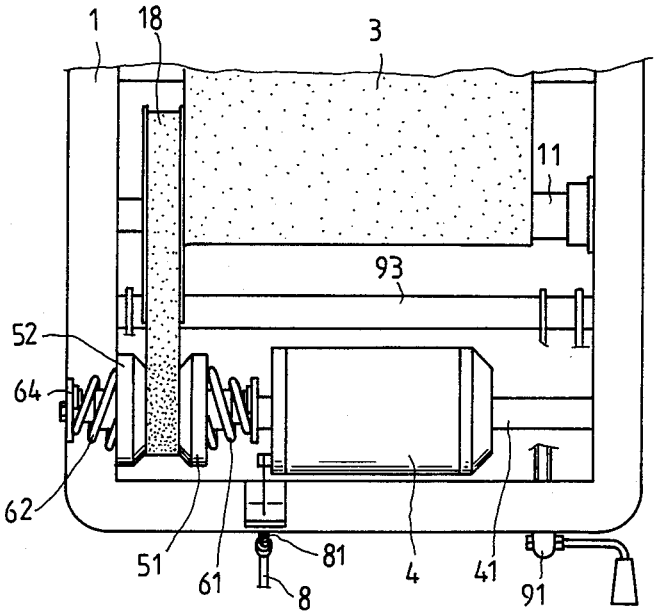
FIG. 5 shows that the clutch discs are forced to move away from each other thereby providing a smaller circumference to engage with the belt when the motor assembly is moved outwards.
Figure 6:
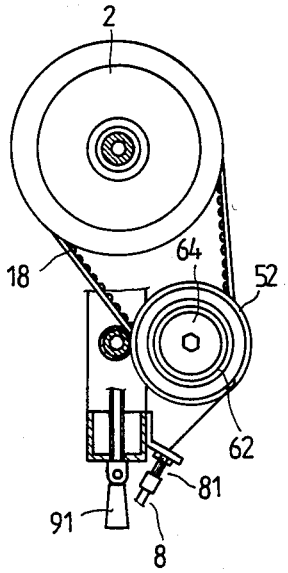
FIG. 6 is a side view of FIG. 5.
Figure 7:
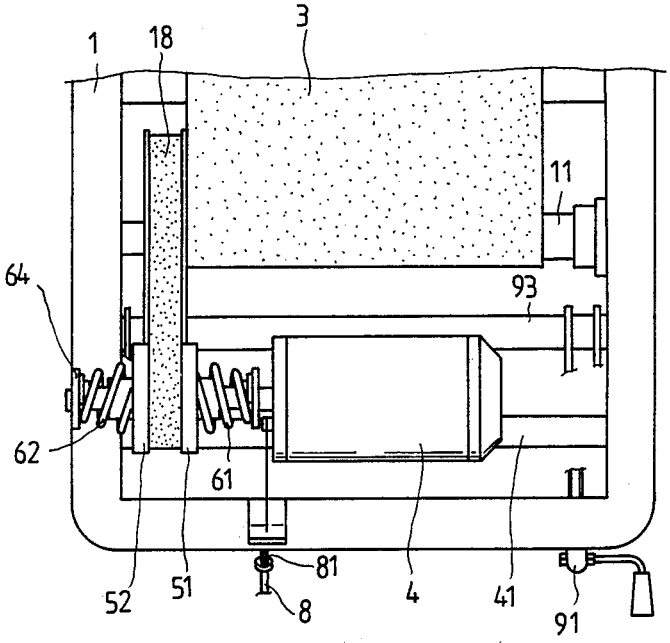
FIG. 7 shows that the clutch discs bear against each other thereby providing a larger circumference to engage with the belt when the motor assembly is moved inwards.
Figure 8:
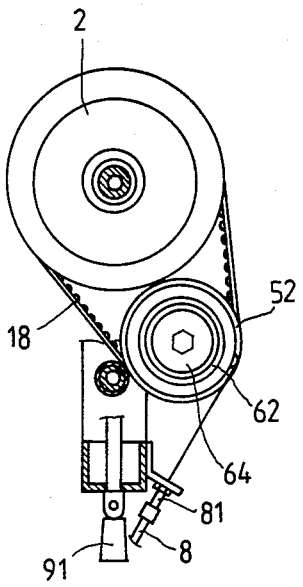
FIG. 8 is a side view of FIG. 7.
Figure 9:
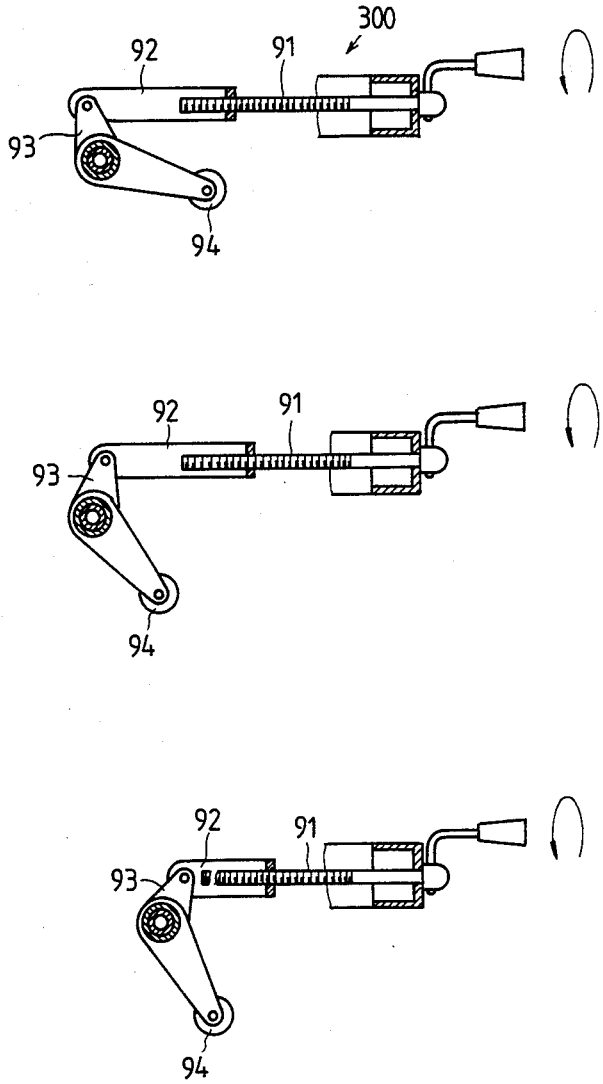
FIG. 9 shows the mechanism of the stand for lifting the front end of the base frame to incline the track to form a slope.

The present invention is mainly characterized by the motor assembly 4 which may change its position to adjust the moving speed of the endless loop 3. This is due to the fact that the tubular rod 41 can be rotated with respect to the first fixed rod 13. As a result, the motor assembly 4 could be moved outwards by an external force (see FIGS. 2, 5 and 6). A speed control mechanism 200 including a housing 7 having therein a movable block 71 is provided on one of the inverted U-shaped member 15. Referring to FIG. 3, the movable block 71 has at the center a threaded hole connected with a screw 73 of a handle 72. A cable wire 8 is attached at one end to the movable block 71 and at the other end to the motor assembly 4. As the handle 72 is rotated, the movable block 71 will move upwards or downwards. When the movable block 71 is moved upwards, the cable wire 8 will pull the motor assembly 8 outwards, thereby increasing the distance between the conical clutch discs 51 and 52 and the pulley 2. Consequently, the belt 18 will force the two conical clutch discs 51 and 52 to move away from each other and so the circumference engaged with the belt 18 becomes smaller. Similarly, as the movable block 71 is moved downwards, the cable wire will increase in length; thus, the motor assembly 8 will move inwards and the tension on the belt 18 will decrease. Hence, the conical clutch discs 51 and 52 will move towards each other, increasing the circumference engaged with the belt 18. Since the driving shaft 42 rotates at a constant speed, the pulley 2 will rotate faster when the circumference engaged with the belt 18 is larger. In a similar way, the pulley 2 will rotate slower when the circumference engaged with the belt 18 is smaller. In other words, the larger the circumference engaged with the belt 18, the higher the speed of the endless loop 3, and the smaller the circumference engaged with the belt 18, the lower the speed of the endless loop 3. However, it should be noted that the speed control mechanism is the conical clutch discs 51 and 52 even when the movable block 71 is moved down to its lowest position and the belt 18 will not get in touch with the driving shaft 42 even when the movable block 71 is moved up to its highest position.

As a result, the speed of the present invention can be regulated by the speed control mechanism in association with the motor assembly 4. To make up for the deviation of the motor assembly 4 caused by the wearing of the belt 18, the speed control mechanism 200 is further provided with an adjusting screw 81.

Another characteristic of the present invention is that the front end of the base frame 1 can be adjusted in height so as to incline the endless loop 3 to form a slope enabling the user to run thereon. Tuning to FIGS. 1, 2 and 4, an adjustable stand 300 is provided on the base frame 1 for regulating the slope. The adjustable stand 300 is provided with a screw 91 engaged with a U-shaped element 92 which is in turn connected with a tubular member 93 enclosing the second fixed rod 14. As the screw 91 is turned into the U-shaped element 92, the tubular member 93 will rotate downwards thereby lifting the front portion of the base frame 1 and therefore, inclining the endless loop 3 to form a slope. Normally, the base frame 1 is kept horizontal. Further, the adjustable stand 300 is provided with wheels 94 for preventing the ground from being damaged.

Although this invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A running exerciser comprising:

a base frame having a first shaft mounted approximate the front part thereof, a second shaft mounted across rear part thereof, a first fixed rod mounted between the front end of the base frame and the first shaft, and a second fixed rod mounted between the front end of the base frame and the first shaft;

a pair of inverted U-shaped members each mounted at one side of said base frame;

an endless loop track wrapping around the first shaft and the second shaft;

a pulley fastened on one end of said first shaft;

a motor assembly provided with a driving shaft having a key formed integrally therewith and a tubular rod put over said second fixed rod;

a stop disc put over the driving shaft of the motor assembly;

a first spring enclosing the driving shaft of the motor assembly and bearing against the stop disc;

a pair of clutch discs each having a conical surface and a keyway adapted to the key of the driving shaft of the motor assembly, said conical clutch discs being put over said driving shaft with the conical surface thereof facing each other;

a second spring means enclosing the driving shaft of the motor assembly and forcing the conical clutch discs to move towards each other;

a stop plate fixedly connected to free end of the driving shaft of the motor assembly by a screw;

a belt connecting said pulley with said clutch discs;

a speed control mechanism mounted on one of said inverted U-shaped members, said mechanism including a housing having therein a movable block, a screw fixed in said housing and threadedly connected with said movable member, and a cable wire connected at one end with the movable block and at the other end with the motor assembly; and, an adjustable stand mounted on a lower front end of said base frame, said adjustable stand having a screw engaged with a U-shaped element which is in turn connected with said tubular member enclosing said first fixed rod wherein said tubular member has at least one leg member projecting radially outward from said tubular member, whereby when said screw is turned into said U-shaped element, said tubular member will rotate downward causing said at least one leg member to rotate downward thereby lifting the front end of said base frame.

* * * * *